US007469942B2

(12) United States Patent
Whitaker et al.

(10) Patent No.: US 7,469,942 B2
(45) Date of Patent: Dec. 30, 2008

(54) DELAYED EGRESS EXIT DEVICE

(75) Inventors: Andrew Whitaker, Knoxville, TN (US); J. Steven Gray, Maryville, TN (US); Sidney J. Lampley, Monroe, NC (US); Michael Ensley, Norris, TN (US); Larry R. Hunt, Sebring, FL (US)

(73) Assignee: Yale Security Inc., Monroe, NC (US)

( * ) Notice: Subject to any disclaimer, the term of this patent is extended or adjusted under 35 U.S.C. 154(b) by 137 days.

(21) Appl. No.: 10/497,116

(22) PCT Filed: Sep. 30, 2002

(86) PCT No.: PCT/US02/31514

§ 371 (c)(1),
(2), (4) Date: Dec. 23, 2004

(87) PCT Pub. No.: WO2004/031517

PCT Pub. Date: Apr. 15, 2004

(65) Prior Publication Data

US 2005/0104381 A1 May 19, 2005

(51) Int. Cl.
*E05B 65/10* (2006.01)
*E05B 65/00* (2006.01)

(52) U.S. Cl. ..... 292/92; 292/93; 292/DIG. 65; 70/92

(58) Field of Classification Search ..... 292/92, 292/93, DIG. 65, 144; 70/92
See application file for complete search history.

(56) References Cited

U.S. PATENT DOCUMENTS 3,663,047 A 5/1972 Zawadzki
3,730,574 A 5/1973 Zawadzki
3,767,238 A 10/1973 Zawadzki
4,021,065 A 5/1977 Geringer
4,099,752 A 7/1978 Geringer
4,167,280 A * 9/1979 Godec et al. ..... 292/92
4,257,631 A 3/1981 Logan, Jr.
4,314,722 A 2/1982 Logan, Jr.
4,328,985 A 5/1982 Logan
4,384,738 A * 5/1983 Floyd ..... 292/92
4,540,208 A * 9/1985 Logan et al. ..... 292/341.19

(Continued)

*Primary Examiner*—Carlos Lugo
(74) *Attorney, Agent, or Firm*—Michael G. Johnston; Kathleen M. Lynch; Moore & Van Allen, PLLC

(57) ABSTRACT

A touch bar (24) exit device (20) comprises a retractor element (50) disposed in the housing (22) for substantially restilinear movement. The retractor element (50) connects the touch bar (24) and the latch bolt (82) such that the retractor element (50) and the latch bolt (82) are moved toward the retracted position in response to movement of the touch bar (24). An electrically energizable locking mechanism (104) in the exit device (20) includes a reciprocating plunger (106) moving transverse to the retractor element (50). When energized, the locking mechanism (104) is operative to move the plunger (106) to the projected locking position to prevent retraction of the latch bolt. A time delay circuit is connected to the locking mechanism (104). A switch (120) actuated in response to movement of the touch bar (24) is connected to the time delay circuit for starting a predetermined time interval for temporarily delaying deenergization of the locking mechanism (104). When the time delay circuit interrupts power to the locking mechanism (104), the plunger (106) moves allowing the latch bolt (82) to move to the retracted position.

15 Claims, 6 Drawing Sheets

U.S. PATENT DOCUMENTS 4,652,028 A 3/1987 Logan et al.
4,741,563 A 5/1988 Cohrs
4,763,937 A * 8/1988 Sittnick et al. ..... 292/251.5
4,784,415 A * 11/1988 Malaval ..... 292/144
4,796,931 A 1/1989 Heid
4,801,163 A * 1/1989 Miller ..... 292/92
4,875,722 A 10/1989 Miller et al.
4,887,442 A 12/1989 Lavelle
4,902,053 A 2/1990 Hakkarainen et al.
4,976,476 A * 12/1990 Cross et al. ..... 292/92
4,984,385 A * 1/1991 DeLand ..... 49/280
5,011,199 A 4/1991 Lowe et al.
5,085,475 A 2/1992 Austin et al.
5,412,961 A 5/1995 Cain et al.
5,429,399 A 7/1995 Geringer et al.
5,605,362 A 2/1997 Surko, Jr.
5,746,458 A 5/1998 Fisher
5,823,582 A 10/1998 Frolov et al.
5,988,708 A 11/1999 Frolov et al.
6,048,000 A 4/2000 Geringer et al.
6,386,597 B1 * 5/2002 Walsh, III ..... 292/92
6,666,054 B1 * 12/2003 Hsieh ..... 70/257

* cited by examiner

DELAYED EGRESS EXIT DEVICE

BACKGROUND

This invention relates generally to an exit device for a door, and more particularly to a delayed egress exit device which may be used in a door security system.

Exit devices generally include a frame or housing secured across a door face and substantially spanning the width of the door. A touch bar is movably mounted to the frame. The touch bar is mechanically linked to a latch mechanism including a door latch which is movably mounted adjacent to a free edge of the door. Depressing the touch bar in the frame toward the door translates the mechanical linkage for actuating the latch mechanism in order to retract the door latch, which may be a rim latch or vertical rods with ceiling and floor latches, so that the door can be opened.

There are circumstances in which immediate opening of the door when the touch bar is pushed is not desirable, generally because some exit doors must remain secured until authorized personnel can arrive. For example, delayed egress exit devices are used on retail store doors to prevent shoplifters from escaping with stolen articles. If a shoplifter's exit can be delayed for a brief period of time, and a signal emitted when the exit device is pushed, store personnel will have an opportunity to monitor the exiting party. A delayed egress exit device is also useful for reasons of safety. For example, the security of a hospital or nursing home exit door should be maintained to delay persons from leaving without authority, or the proper assistance, in other than emergency situations. If a person's exit can be delayed long enough after the exit device is operated, they can be prevented from leaving.

Conventionally, delayed egress is accomplished through the combination of an exit device with an internal, electrically-powered delaying mechanism associated with the latch mechanism. The delaying mechanism is generally interposed between the touch bar and the door latch to prevent the immediate opening of the door. The delaying mechanism provides a delay period following an effort to exit through the door before actuating the door latch mechanism to retract the latch and allow the door to open. The preset delay period allows time for personnel to arrive at the site of the door, or otherwise respond if required to assist or prevent egress.

Delayed egress exit devices may further comprise audible or visual alarms at the location of the door, or at a remote location, to signify attempted egress or ingress. Such exit devices are often incorporated into overall security systems which readily interface with electromagnetic lock systems, including readers, touch pads, electronic keys or other personal identification security measures, to control both egress and ingress through the door.

Unfortunately, delayed egress exit device delay mechanisms generally require complicated internal arrangements to function properly. These complicated internal arrangements are difficult to manufacture and also may be prone to failure in critical emergency situations.

For the foregoing reasons, there is a need for a simple, reliable arrangement for use in an exit device for effecting delayed egress.

SUMMARY

According to the present invention, an apparatus is provided for use with an exit device for delaying egress through a door, the exit device including an electrically energizable locking mechanism mounted within the exit device housing and which is operative to prevent a latch bolt from moving to a retracted position when the locking mechanism is energized. A retractor element is adapted to be disposed in the exit device housing for substantially rectilinear movement relative to the housing from a first position to a second position. The retractor element is further adapted to be operatively connected between a movable actuator member on the exit device and the latch bolt. The retractor element is moved toward the second position of the retractor element, and the latch bolt toward the retracted position, in response to movement of the actuator member. A plunger is adapted to be disposed in the locking mechanism for relative reciprocal movement transverse to the direction of movement of the retractor element between a projected locking position when the locking mechanism is energized and a retracted non-locking position. The retractor element has an opening for receiving the plunger when the plunger is in the projected locking position.

Also according to the present invention, an exit device is provided for use with a door pivotally mounted along one edge for movement about an axis. The exit device comprises a housing having a longitudinal axis which is adapted to be secured to the door surface. A latch bolt is disposed at one end of the housing adjacent an edge of the door and movable relative to the housing between a projected position extending outwardly of the housing for latching the door in a closed position and a retracted position where the latch bolt is inside the housing for allowing the door to be opened. An actuator member is mounted on the housing for movement relative to the housing from a first position to a second position. A retractor element is disposed in the housing for substantially rectilinear movement relative to the housing from a first position to a second position in a path along the longitudinal axis of the housing. The retractor element is operatively connected between the actuator member and the latch bolt, and is moved the second position of the retractor element, and the latch bolt is moved toward the retracted position, in response to movement of the actuator member toward the second position of the actuator member. The retractor element includes a first linkage operatively connected to the actuator member and a second linkage movable relative to the first linkage and operatively connected to the latch bolt. A connector slidably connects the first and second linkages, and a spring positioned between and engaging the first and second linkages biases the linkages in opposite directions. An electrically energizable locking mechanism is mounted to the housing, including a plunger supported in the housing for relative reciprocal movement transverse to the longitudinal axis of the housing between a projected locking position and a retracted non-locking position. The locking mechanism is operative to move the bolt to the projected locking position when energized. The second linkage has an opening for receiving the plunger when the plunger is in the projected locking position. A time delay circuit is connected to the locking mechanism for controlling electrical power supplied to the locking mechanism. A switch is actuated in response to movement of the actuator member toward the second position. The switch is connected to the time delay circuit for starting a predetermined time interval upon actuation of the switch for temporarily delaying deenergization of the locking mechanism after the actuator member is moved toward the second position. When the locking mechanism is energized, movement of the actuator member toward the second position of the actuator member moves the first linkage to the second position of the first linkage thereby loading the spring and starting the time interval. The time delay circuit interrupts electrical power to the locking mechanism upon expiration of the time interval allowing the plunger to move to the non-locking retracted position and the second linkage to move to the second position of the second linkage under force of the spring for moving the latch bolt to the retracted position.

Further according to the present invention, an apparatus for sensing when a door is in a closed position is provided for use in an exit device including a latch bolt which in a projected position extends outwardly of the exit device for latching the door in a closed position. The sensing apparatus comprises a sensor disposed in the exit device adjacent to the latch bolt for sensing a sensed element mounted to the door frame when the door is latched in the closed position.

Still further according to the present invention, an exit device is provided for use with a door. The exit device comprises a housing adapted to be secured to the door surface. A latch bolt is disposed at one end of the housing adjacent an edge of the door and movable relative to the housing between a projected position extending outwardly of the housing for extending into the door frame and latching the door in a closed position and a retracted position where the latch bolt is inside the housing for allowing the door to be opened. An actuator member is mounted on the housing for movement relative to the housing from a first position to a second position. Linkage disposed in the housing operatively connects the actuator member and the latch bolt such that the latch bolt is moved toward the retracted position in response to movement of the actuator member toward the second position of the actuator member. A sensed element is mounted to the door frame. A sensor is disposed in the housing adjacent to the latch bolt for sensing the sensed element when the door is latched in the closed position.

Further yet according to the present invention, a securing system is provided for a door wherein a latch is operable by an associated exit device to match the door to allow the door to move to an open position. The securing system comprises an electrically energizable locking mechanism adapted to be mounted in the exit device. The locking mechanism includes a plunger supported in the housing for relative reciprocal movement between a projected position and a retracted position. The plunger is adapted to prevent operation of the exit device when the plunger is in the locking position for securing the door in the closed condition. When energized, the locking mechanism is operative to move the plunger to the projected locking position. A time delay circuit is connected to the locking mechanism for controlling electrical power supplied to the locking mechanism. The time delay circuit includes a switch for producing a signal indicating an attempt to open the door and a timer connected to the switch for receiving the signal and starting a predetermined time interval for temporarily delaying deenergization of the locking mechanism. The time delay circuit interrupts electrical power to the locking mechanism upon expiration of the time interval allowing the exit to operate to unlatch the door.

BRIEF DESCRIPTION OF DRAWINGS

For a more complete understanding of the present invention, reference should now be had to the embodiments shown in the accompanying drawings and described below. In the drawings.

DESCRIPTION

The present invention provides a delayed egress exit device that temporarily locks a door for a predetermined time period after the exit device is initially actuated. The time delay mechanism according to the present invention is for use in a commercial exit device and may be used with any conventional touch bar exit device such as, for example, the exit device described by U.S. Pat. No. 4,796,931 or U.S. Pat. No. 5,605,362, the contents of both of which are hereby incorporated by reference. Accordingly, detailed explanations of the functioning of all of the exit device components are deemed unnecessary for understanding the present invention by one of ordinary skill in the art.

Certain terminology is used herein for convenience only and is not to be taken as a limitation on the invention. For example, words such as "upper,""lower," "left,""right,""horizontal,""vertical,""upward," and "downward" merely describe the configuration shown in the FIGs. Indeed, the components may be oriented in any direction and the terminology, therefore, should be understood as encompassing such variations unless specified otherwise.

Figure 1:
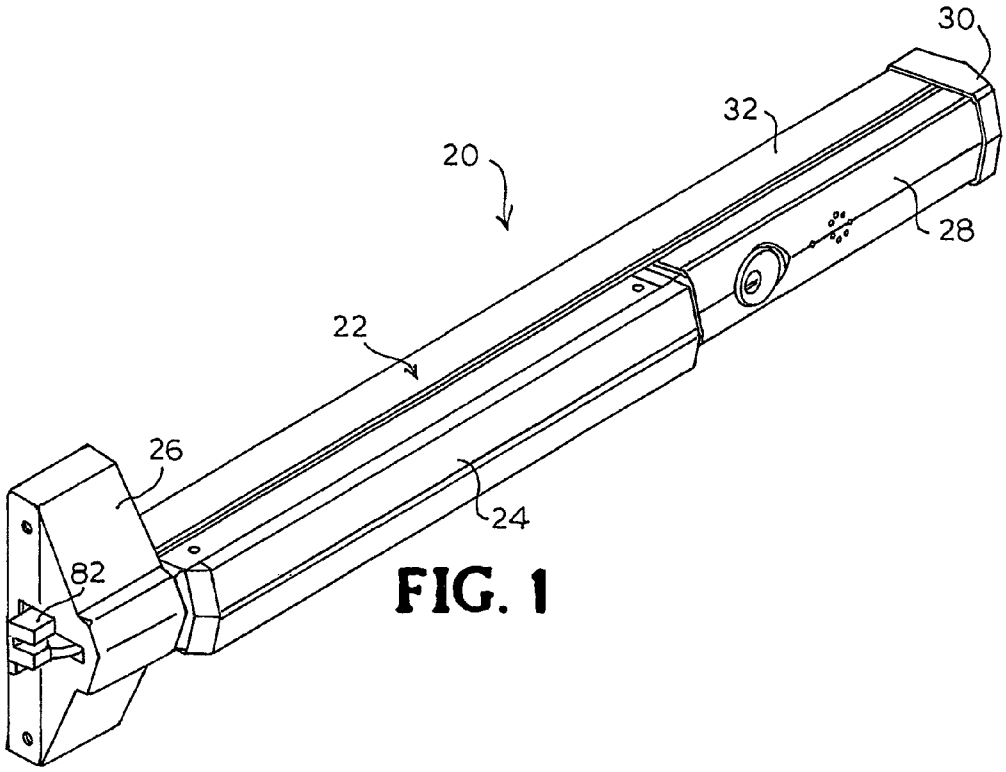
FIG. 1 is a perspective view of an exit device according to the present invention.

Referring now to the drawings, wherein like reference numerals designate corresponding or similar elements throughout several views, FIG. 1 shows an exit device 20 according to the present invention. The exit device 20 includes an elongated housing 22 that is mounted at a horizontal position across the interior surface of a door (not shown) to be secured. The housing 22 comprises a touch bar 24, a latch housing 26 at one end and a cover plate 28 having an end cap 30 at the other end. The touch bar 24 longitudinally spans a substantial portion of the housing 22 and defines a face for receiving a pushing force exerted toward the door by a person attempting to egress through the door. A U-shaped shield 32 fits around and slides over a frame 34 (not seen in FIG. 1) comprising side rails 36 and a base plate 38. The web portion of the shield 32 is adapted to be mounted flat against the surface of the door.

Figure 2:
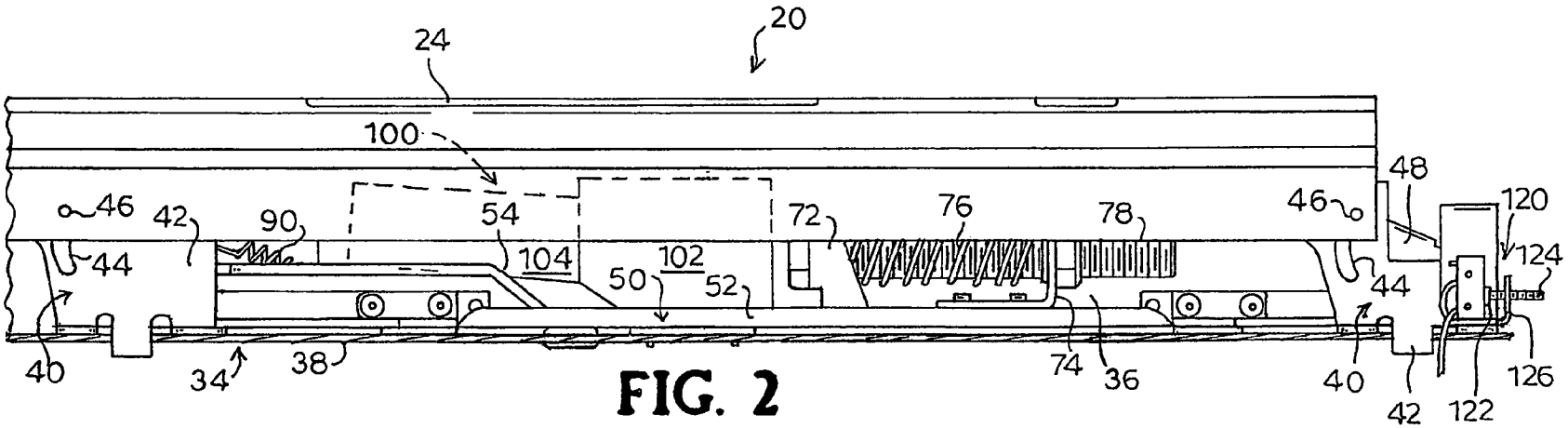
FIG. 2 is a side elevation view of a portion of the exit device shown in FIG. 1 with a cover plate and shield removed and showing a locking mechanism partially in phantom.

FIG. 2 shows the exit device 20 of the present invention with the cover plate 28 and shield 32 removed. A pair of spaced touch bar mounts 40 are seen secured to the base plate 38. The sidewalls 42 of the touch bar mounts 40 extend transversely from the base plate 38 and are slotted in an arc 44. A pair of pins 46 are rigidly mounted between the side walls of the touch bar 24 and pass through the slots 44 in the touch bar mounts 40. An L-shaped lever arm 48 is pivotally attached at its vertex to each of the touch bar mounts 40. A first leg of each lever arm 48 is connected at its distal end to the touch bar pin 46 that travels in the associated slot 44 for drivingly connecting the touch bar 24 to the lever arms 48. According to the present invention, the distal end of the second leg of each lever arm 48 is pivotally connected to an elongated slide assembly 50. The slide assembly 50 is movably mounted relative to the frame 34 so that movement of the touch bar 24 transversely inwardly toward the door will move the slide assembly 50 longitudinally of the housing 22.

Figure 3:
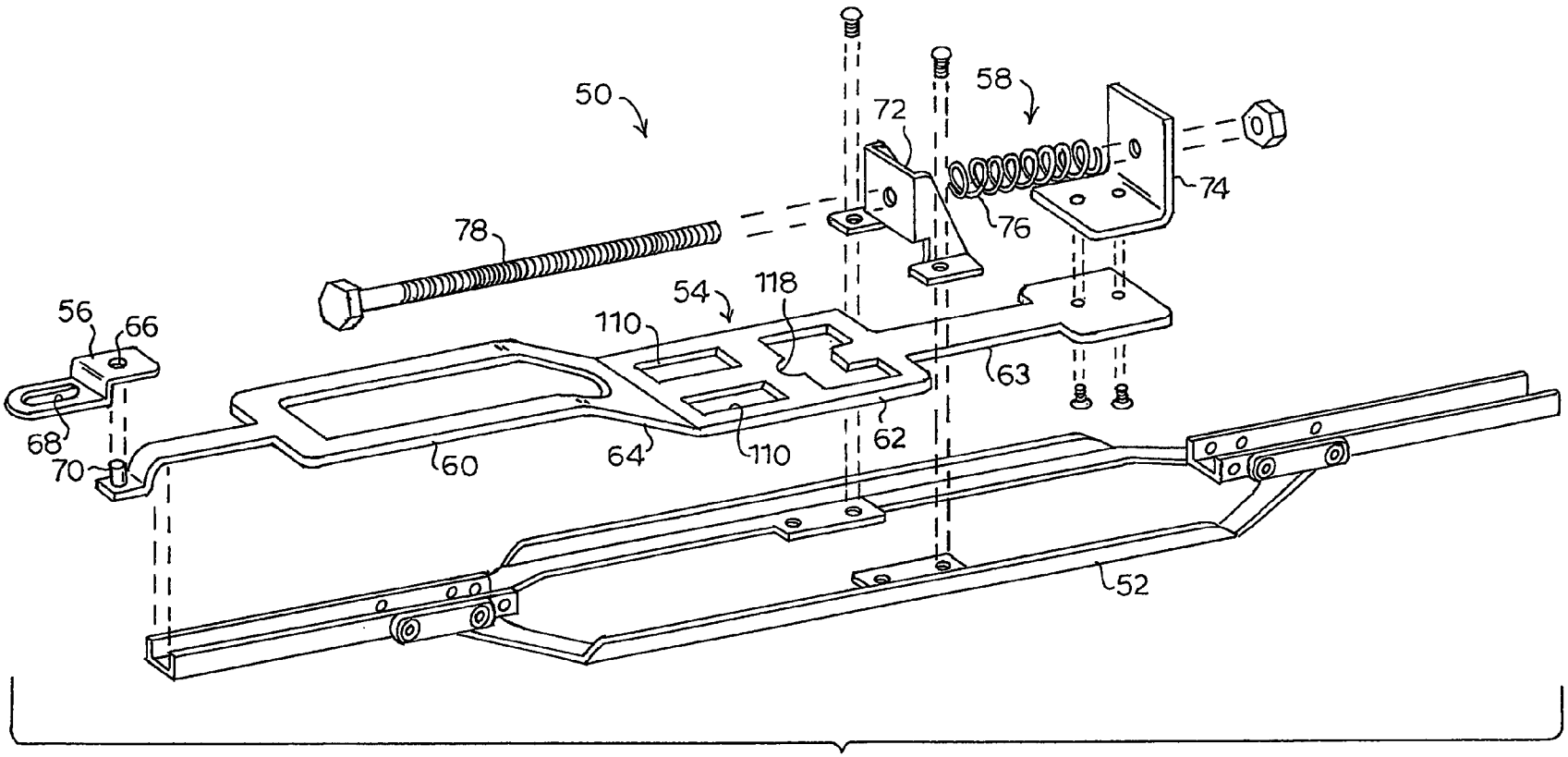
FIG. 3 is an exploded perspective view of a portion of an actuating mechanism for use in the exit device shown in FIG. 1 according to the present invention.

As shown in FIG. 3, the slide assembly 50 comprises two sliding brackets: a base slide 52 and a latch slide 54, a latch actuator tongue 56 and a spring assembly 58. The base slide 52 is a substantially flat bracket piece disposed adjacent the base plate 38. The base slide 52 is attached at each end to the second legs of the lever arms 48. The latch slide 54 is a bracket having a substantially flat front portion 60 and rear portion 62 which are joined by an intermediate upwardly angled portion 64 so that the front portion 60 is in a different plane than the rear portion 62. The latch slide 54 fits over the base slide 52 such that the rear portion 62 of the latch slide 54 is slidably received in the channels defined by the upstanding sides of the base slide 52. The latch actuator tongue 56 is a short link having openings 66, 68 at each end. The rear opening 66 of the latch actuator tongue 56 receives a pin 70 integral with the front portion 60 of the latch slide 54.

The spring assembly 58 includes a triangular front bracket 72 and a rear bracket 74. The front spring bracket 72 is attached to the base slide 52 such that the legs of the front bracket straddle a narrow section 63 of the rear portion 62 of the latch slide 54. The rear spring bracket 74 is attached to the latch slide 54 rearwardly of the front bracket 72. A coil spring 76 is slidingly positioned on a bolt 78 between the brackets 72, 74 for biasing the latch slide 54 rearwardly with respect to the base slide 52. The openings in the brackets 72, 74 receiving the bolt 78 are sized to allow the brackets 72, 74 to move freely along the bolt. Thus, the base slide 52 and the latch slide 54 are connected for movement together through the spring 76. Further, the difficulty of the relative movement of the latch slide 54 with respect to the base slide 52 may be adjusted using the bolt 78.

Figure 4:
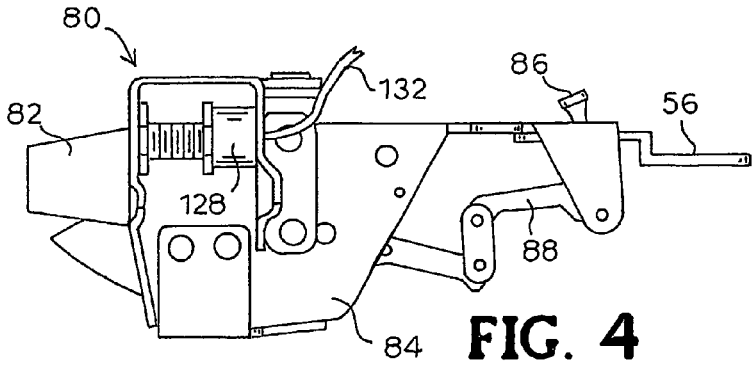
FIG. 4 is a top plan view of a latch assembly for use in the exit device shown in FIG. 1 according to the present invention.
Figure 5:
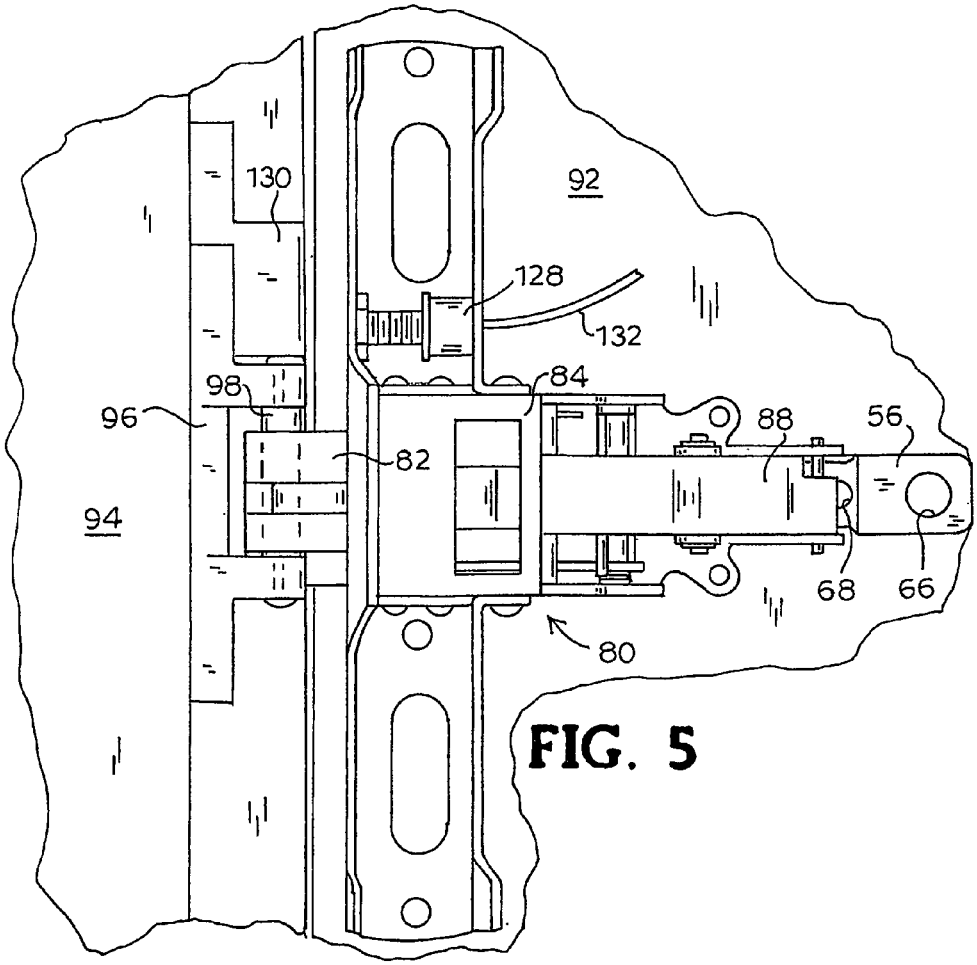
FIG. 5 is a side fragmentary elevation view of the latch assembly shown in FIG. 4 mounted on a door and adjacent to a door frame.

A latch mechanism 80, shown in FIGS. 4 and 5, is secured to the base plate 38. The latch mechanism 80 includes a latch bolt 82 mounted in a latch housing 84 for reciprocal axial movement from a projected position beyond the latch housing 84 to a retracted position. The latch bolt 82 depicted in the FIGs. is a deadbolt which, along with the latch mechanism 80, is described in the '362 patent cited above. It is understood that the latch bolt may be pivotally mounted, as in a latch mechanism according to a conventional rim device, a mortise device, or floor and ceiling latches as in a concealed vertical rod latch assembly, or a combination of the above. Moreover, in each of the embodiments of the present invention, the exit device depicted, except for the exit delay mechanisms, is constructed and functions like those well known in the art, and as disclosed in the '362 and '931 patents.

The free edge of the door 92, partially shown in FIG. 5, is adapted to fit adjacent a surface of a door frame 94 from which the door 92 is supported when the door 92 is in a closed position. A suitable strike 96 and keeper roller 98 are mounted to the door frame 94. In the projected position, the latch bolt 82 fits behind the keeper roller 98 to prevent movement of the door from the closed position about its hinged axis.

As seen in FIGS. 4 and 5, the front opening 68 of the latch actuator tongue 56 is adapted to receive a spherical end of a pin 86 extending from a dog bone lever 88 pivotally mounted on the frame 34. The front opening 68 is elongated to permitting movement of the latch bolt 82 toward the retracted position without movement of the latch slide 54. The latch bolt 82 is moved to the retracted position in response to movement of the latch slide 54 from a first position corresponding to the projected position of the latch bolt 82 to a second position corresponding to the retracted position of the latch bolt 82.

Figure 6:
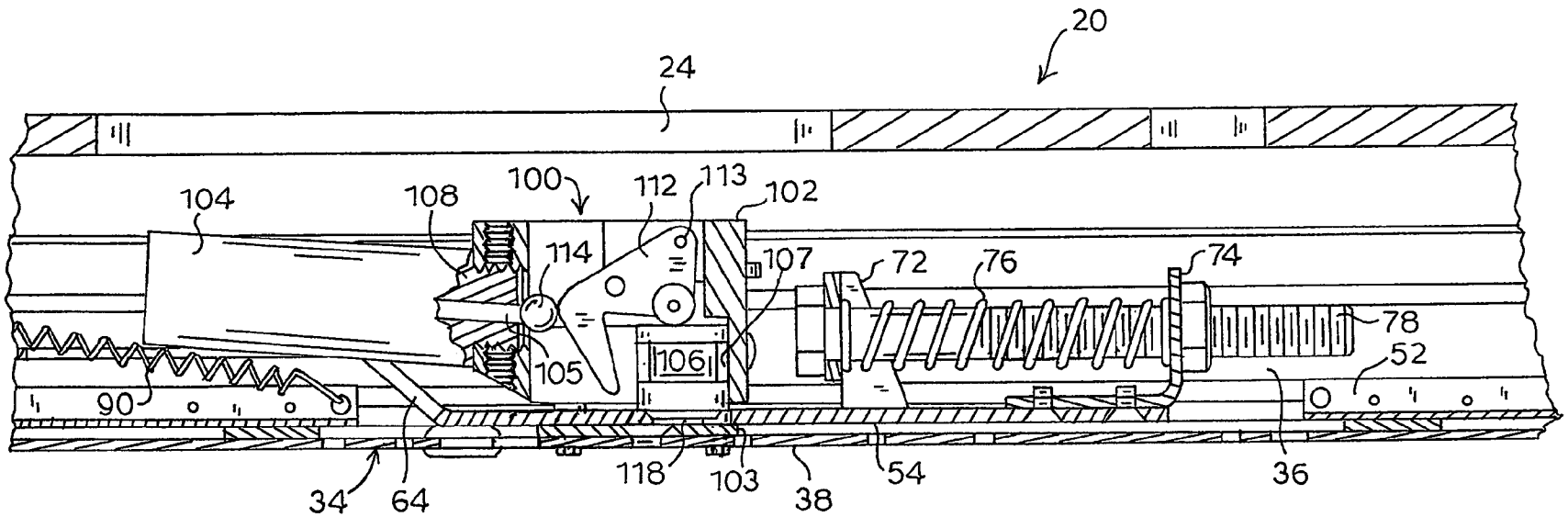
FIGS. 6-8 are longitudinal cross sections of a portion of the exit device shown in FIG. 1 showing the exit device in a locked condition, in the locked condition with the press bar pushed toward the door, and in an unlocked and unlatched condition, respectively.
Figure 7:
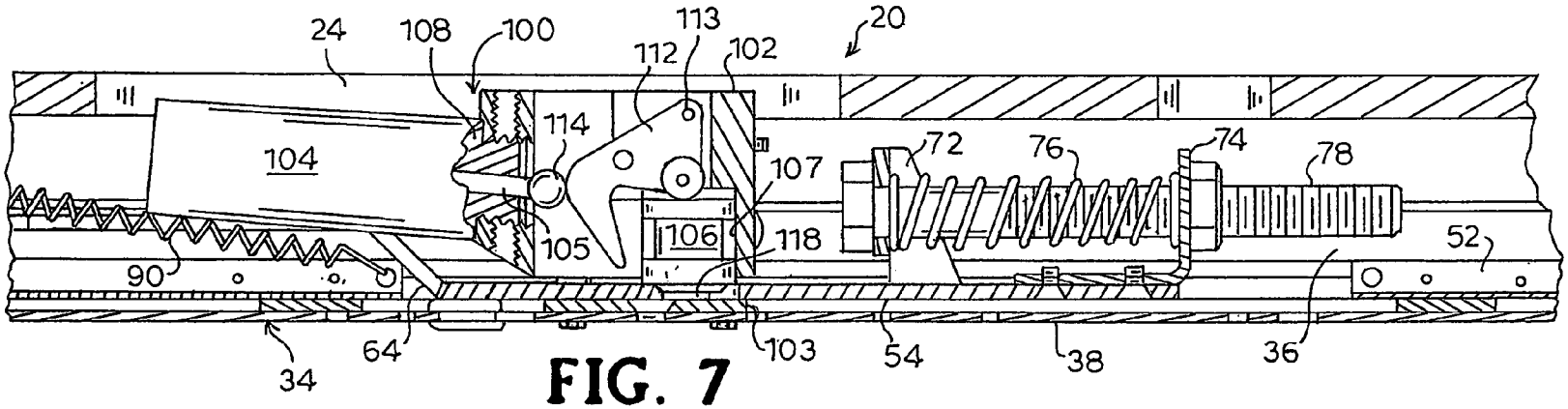
Figure 8:
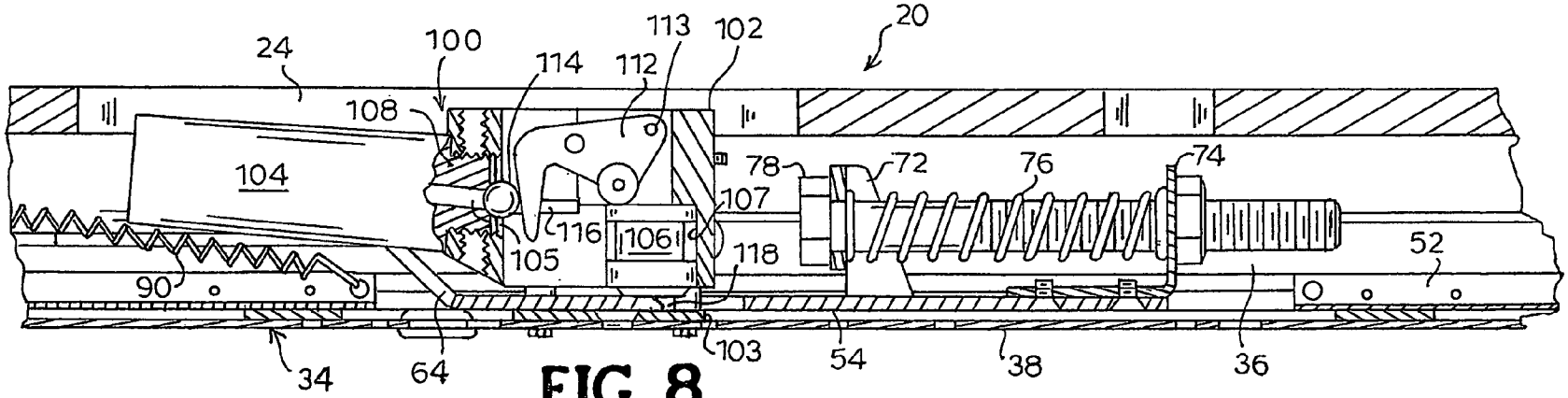

Retraction of the latch bolt 82 from inside of the door is achieved by pushing the touch bar 24 inwardly toward the door as is conventional. Transverse movement of the touch bar 24 pivots the lever arms 48 through an arc motion which is translated into a generally longitudinal motion at the bottom of the pivoting lever arms 48. The connection between the lever arms 48 and base slide 52 causes the base slide 52 to reciprocate rearwardly in the frame 34 toward the hinged edge of the door (not shown). This movement also causes rearward movement of the latch slide 54, which swings the pin 86 in the latch actuator tongue 56 rearward to actuate the latch mechanism 80 to retract the latch bolt 82 allowing the door 92 to be opened. When the touch bar 24 is subsequently released from the manual pressure, the touch bar 24 returns to the position shown in FIG. 1 due to the force of return springs, one of which is shown in FIGS. 6-8 at 90.

Lock trim (not shown), such as a handle and a rim cylinder, may be installed on the opposite side of the door and operatively connected with the latch mechanism 80 so that the latch mechanism can be operated from the opposite side of the door. The connection between the outside cylinder and the projection is described in the '931 patent cited above.

According to the present invention, an electrically-actuated locking mechanism 100 is provided for selectively locking the exit device 20 to secure the door. As best seen in FIG. 6, the locking mechanism 100 includes a housing 102, a solenoid 104 fixed to the housing 102, and a reciprocating cylindrical plunger 106 disposed in a bore 107 in the housing 102. A time delay circuit (not shown) is coupled to the solenoid 104. The solenoid 104 includes an armature 108 which operatively surrounds an inductively movable bar 105. An angle lever 112 is swingingly mounted at pin 113 in the lock mechanism housing 100 and includes a transverse roller 115. A nylon ball 114 is positioned in a grooved passage 116 in the housing in the path of the solenoid bar 105 between the end of the bar and the angle lever 112. The structure and operation of a suitable locking mechanism is described in U.S. Pat. No. 4,099,752, the contents of which are hereby incorporated by reference. A suitable locking mechanism for use in the present invention is available from SDC Security Door Controls of Westlake Village, Calif.

The locking mechanism housing 102 is secured to the frame 34 through slotted openings 110 in the latch slide 54 so that the slide assembly 50 can move relative to the lock mechanism 100. The housing 102 is positioned on the frame 34 so that the bore 107 opens into an opening 118 formed in the latch slide 54 when the latch bolt 82 is in a projected position. The operating axis of the plunger 106 is in right angle relation with respect to the longitudinal axis of the slide assembly 50. Thus, the depth dimension of the exit device 20 is minimized to the extent that it may be readily accommodated by a low profile frame 34 and housing 22.

The locking mechanism 100 operates in response to electrical power for transferring the outward movement of the bar 105 in the solenoid armature 108 to movement of the plunger 106. In a locking position, as represented in FIG. 6, the distal end of the plunger 106 protrudes form the housing 102 and into the opening 118 formed in the latch slide 54. The locking position is effected when the solenoid 104 is energized so that the solenoid bar 105 is extended into the housing 102 for pushing the ball 114 against the swinging angle lever 112. This action rotates the lever 112 in a counterclockwise direction (as seen in FIG. 6). As the lever 112 rotates, the roller 115 moves along the inner surface of the plunger 106 forcing the plunger 106 out of the housing 102 and into the opening 118 in the latch slide 54. When the exit device 20 is in this condition, the latch slide 54 will not move when the touch bar 24 is depressed. Thus, the latch bolt 82 cannot be retracted.

If the force applied to the touch bar 24 exceeds the spring 76 force, the base slide 52 and front spring bracket 72 will be moved rearwardly carried by the pivoting touch bar lever arms 48, as described above, while the latch slide 54 is stationary, thereby compressing the spring 76 until the touch bar 24 comes to a solid stop at the bottom of the slots 44 in the touch bar mounts 40, as represented in FIG. 7. The spring 76 force acting rearwardly on the latch slide 54 is increased. It is understood that the position of the brackets 72, 74 could also be reversed which would cause the spring 76 to lengthen when the touch bar 24 is depressed and the door 92 locked. In either arrangement, the door is held closed as long as power is supplied to the solenoid 104.

When the solenoid 104 is deenergized, as represented in FIG. 8, the solenoid bar 105 is free to move into the solenoid 104, which frees the angle lever 112 to pivot about the pin 113. Since the locking force of the plunger 106 has been removed, and as long as the touch bar 24 remains depressed, the loading of the spring 76 due to depressing the touch bar 24 causes the latch slide 54 to force the plunger 106 into the housing 102 as the latch slide 54 moves to the right (as seen in FIG. 8) to retract the latch bolt 82. The edge of the opening 118 in the latch slide 54 and the lower peripheral edge of the plunger 106 are beveled to facilitate this movement. The door 92 is now unlocked and may be opened by continuing to push on the touch bar 24.

The exit device 20 is supplied with electricity from a power supply over lines in a conventional manner. Power to the solenoid 104 is controlled by a lock control system including electrical circuitry housed in a cavity under the cover plate 28 at the rear of the exit device 20. The shift from the locked to unlocked condition of the exit device 20 is delayed by the electrical circuit. The circuit includes a control switch 120, power supply, and a control panel which is preferably a solid state monolithic circuit, such as one of those produced by several manufactures, which can be adjusted for any desired time limit.

The control switch 120 is mounted on the rear touch bar mount 40. The switch 120 has an exposed actuator 122 which is engaged by a threaded rod 124 received in a bracket 126 at the inner end of the base slide 52. The control switch 120 is electrically connected via lines to the lock control system for controlling the energization of the solenoid 104. Inward movement of the base slide 52 upon depression of the touch bar 24 moves the rod 124 away from the touch bar mount 40 actuating the switch 120 which produces a signal to a time delay circuit logic feature to start a time delay sequence. As described above, the exit device 20 allows normal motion of the touch bar 24 and lever arms 48 and base slide 52 despite the blockage of the latch slide 54. This movement is sufficient to activate the switch 120. It is understood that any switch or other arrangement capable of electrically firing can be used to trigger the locking mechanism 100.

It is understood that the lock control system may assume a wide range of structures and provide for numerous optional capabilities in addition to controlling the time delay before deenergizing the solenoid 104. A suitable lock control system for use in the present invention is available from SDC Security Door Controls of Westlake Village, Calif.

In use, when the door to which the exit device 20 of the present invention is mounted is closed, the latch bolt 82 is extended in the latched position, as shown in FIGS. 1 and 5. The solenoid 104 is energized by the power source and, as a result, the plunger 106 is positioned in the opening 118 in the latch slide 54. Depressing the touch bar 24 pivots the lever arms 48 and moves the base slide 52 to the right, as shown in FIG. 7, triggering the switch 120. The switch 120 functions to initiate the time delay for a predetermined interval. The time delay may be in the range of 15-45 seconds, but in any case is preferably sufficient to stop or report unauthorized egress. Responsible personnel can move to the door during the time delay to ascertain who is trying to exit. When the time delay has run its course, the circuit component interrupts power to the solenoid 104 and the spring 76 force moves the latch slide 54 to the right retracting the latch bolt 82 as long as the touch bar 24 remains depressed.

Upon shutting the door, the coil is reenergized either automatically or manually. Thereafter, the power supply will deliver power continuously to the coil to hold the door locked.

Alarm or other control features of the may also be provided within a security system incorporating the exit device 20 according to the present invention. Audible or visual alarms which have been electrically coupled to the exit device circuitry may be activated when the switch is actuated indicating that someone is trying to open the door. The alarm signal generated can be at the location of the exit device 20 or can be transmitted over lines to a remote monitoring location to indicate that a door opening has been addressed.

The exit device 20 may also be provided to insure that the locking mechanism 100 will operate in a fail-safe mode. Building alarms, smoke alarms, fire alarms, or other emergency condition sensors may be connected in line to the locking mechanism 100 to cut the power from the power supply so that when there is a fire or other emergency condition within the building the door unlocks and can be opened. Consequently, the exit device 20 is available for immediate egress in the normal emergency situation and delayed egress otherwise.

It is understood that the time-delayed circuit can be mounted and controlled from a remote location, if desired, as it only has to be electrically and not physically coupled to the solenoid 104 and the switch 122. The exit device 20 is readily adapted for use in a security system, which may also incorporate a master console at remote location. The exit device 20 also may provide information on its operational status to a single remote location. A master switch may be located at the master console for manually operating the power supply to the exit device 20.

Further in accordance with the present invention, a door position sensor 128 (FIG. 5) is provided for sensing when the door 92 is in the closed position. The door position sensor 128 may be any suitable proximity sensor or non-contact switch, such as a photoelectric switch, a magnetic reed switch, Hall effect sensor, and the like. A magnet 130 is housed in the strike 96. When the door 92 is closed, as seen in FIG. 5, the sensor 128 is subjected to detectable magnetism from the magnet 130 and generates signals indicating the door condition to a door monitoring or control system over the line 132.

Although the present invention has been shown and described in considerable detail with respect to only a particular exemplary embodiments thereof, it should be understood by those skilled in the art that we do not intend to limit the invention to the embodiments since various modifications, omissions and additions may be made to the disclosed embodiments without materially departing from the novel teachings and advantages of the invention, particularly in light of the foregoing teachings. For example, the locking mechanism may be used to effect delayed egress in any conventional exit device wherein a component of latch bolt retraction includes axial movement of an element that can be immobilized. In addition, the slide assembly 50 could be a unitary piece rigidly linking the touch bar 24 and the latch bolt 82. Accordingly, we intend to cover all such modifications, omission, additions and equivalents as may be included within the spirit and scope of the invention as defined by the following claims. In the claims, means-plus-function clauses are intended to cover the structures described herein as performing the recited function and not only structural equivalents but also equivalent structures. Thus, although a nail and a screw may not be structural equivalents in that a nail employs a cylindrical surface to secure wooden parts together, whereas a screw employs a helical surface, in the environment of fastening wooden parts, a nail and a crew may be equivalent structures.

We claim:

1. An exit device for use with a door pivotally mounted along one edge for movement about an axis, the exit device comprising:

a housing having a longitudinal axis, the housing adapted to be secured to the door surface;

a latch bolt disposed at one end of the housing adjacent an edge of the door and movable relative to the housing between a projected position extending outwardly of the housing for latching the door in a closed position and a retracted position where the latch bolt is inside the housing for allowing the door to be opened;

an actuator member mounted on the housing for movement relative to the housing from a first position to a second position;

a retractor element disposed in the housing for substantially rectilinear movement relative to the housing from a first position to a second position in a path along the longitudinal axis of the housing, the retractor element operatively connected between the actuator member and the latch bolt, the retractor element moving toward the second position of the retractor element and the latch bolt moving toward the retracted position in response to movement of the actuator member toward the second position of the actuator member, the retractor element including a first linkage operatively connected to the actuator member, a second linkage movable relative to the first linkage and operatively connected to the latch bolt, a connector slidably connecting the first and second linkages, and a spring positioned between and engaging the first and second linkages for biasing the linkages in opposite directions;

an electrically energizable locking mechanism mounted to the housing, the locking mechanism including a reciprocating plunger for movement transverse to the longitudinal axis of the housing between a projected locking position and a retracted non-locking position, the second linkage having an opening for receiving the plunger when the plunger is in the projected locking position, the locking mechanism operative to move the bolt to the projected locking position when energized;

a time delay circuit connected to the locking mechanism for controlling electrical power supplied to the locking mechanism; and a switch actuated in response to movement of the actuator member toward the second position, the switch connected to the time delay circuit for starting a time interval upon actuation of the switch for temporarily delaying deenergization of the locking mechanism for a predetermined time interval after the actuator member is moved toward the second position, wherein, when the locking mechanism is energized, movement of the actuator member toward the second position of the actuator member moves the first linkage to the second position of the first linkage for loading the spring and starting the time interval, the time delay circuit interrupting electrical power to the locking mechanism upon expiration of the time interval allowing the plunger to move to the non-locking retracted position and the second linkage to move to the second position of the second linkage under force of the spring for moving the latch bolt to the retracted position.

2. An exit device as recited in claim 1, wherein the actuator member is a manually operated touch bar supported on the housing for movement from the first position spaced from the surface of the door to the second position closer to the door surface.

3. An exit device as recited in claim 1, wherein the locking mechanism comprises a solenoid.

4. The exit device of claim 1 further comprising:

sensed element adapted to be mounted to the door frame; and a sensor disposed in the housing adjacent to the latch bolt for sensing the sensed element when the door is in the closed position.

5. An exit device as recited in claim 4, wherein the sensor is selected from a photoelectric switch, a magnetic reed switch, or a Hall effect sensor.

6. An apparatus for use in the exit device of claim 1 for sensing when a door pivotally mounted along one edge to a door frame for movement about an axis is in a closed position, the door position sensing apparatus comprising:

a sensed element adapted to be mounted to the door frame; and a sensor disposed in the housing adjacent to the latch bolt for sensing the sensed element when the door is latched in the closed position.

7. A door position sensing apparatus as recited in claim 6, wherein the sensor is selected from a photoelectric switch, a magnetic reed switch, or a Hall effect sensor.

8. An apparatus for delaying egress through a door pivotally mounted along one edge for movement about an axis, the exit device including a housing adapted to be secured to the door surface, a latch bolt disposed at one end of the housing adjacent an edge of the door and movable relative to the housing between a projected position extending outwardly of the housing for latching the door in a closed position and a retracted position where the latch bolt is inside the housing for allowing the door to be opened, an actuator member mounted on the housing for movement relative to the housing from a first position to a second position, an electrically energizable locking mechanism mounted to the housing operative to prevent the latch bolt form moving to the retracted position when energized, a time delay circuit connected between the locking mechanism and a power source for controlling electrical power supplied to the locking mechanism, and a switch actuated in response to movement of the actuator member toward the second position, the switch connected to the time delay circuit for starting a time interval upon actuation of the switch for temporarily delaying deenergization of the locking mechanism after the actuator member is moved toward the second position, the apparatus for delaying egress comprising:

a retractor element comprising a first linkage adapted to be operatively connected to the actuator member, a second linkage movable relative to the first linkage and adapted to be operatively connected to the latch bolt, a connector slidably connecting the first and second linkages; and a spring positioned between and engaging the first and second linkages for biasing the linkages in opposite directions, and a plunger disposed in the locking mechanism for relative reciprocal movement transverse to the direction of movement of the retractor element between a projected locking position and a retracted non-locking position, the retractor element having an opening for receiving the plunger when the plunger is in the projected locking position to prevent movement of the retractor element, whereby, when the locking mechanism is energized, movement of the actuator member toward the second position of the actuator member moves the first linkage to the second position of the first linkage loading the spring and starting the time interval, the time delay circuit interrupting electrical power to the locking mechanism upon expiration of the time interval allowing the plunger to move to the non-locking retracted position and the second linkage to move to the second position of the second linkage under force of the spring for moving the latch bolt to the retracted position.

9. In combination, a door frame;

a door hinged along one edge to the door frame;

an exit device comprising a housing having a longitudinal axis, the housing secured to the door surface, a latch bolt disposed at one end of the housing adjacent an edge of the door and movable relative to the housing between a projected position extending outwardly of the housing for latching the door in a closed position and a retracted position where the latch bolt is inside the housing for allowing the door to be opened, an actuator member mounted on the housing for movement relative to the housing from a first position to a second position, a retractor element disposed in the housing for substantially rectilinear movement relative to the housing from a first position to a second position in a path along the longitudinal axis of the housing, the retractor element operatively connected between the actuator member and the latch bolt, the retractor element moving toward the second position of the retractor element and the latch bolt moving toward the retracted position in response to movement of the actuator member toward the second position of the actuator member, the retractor element including a first linkage operatively connected to the actuator member, a second linkage movable relative to the first linkage and operatively connected to the latch bolt, a connector slidably connecting the first and second linkages, and a spring positioned between and engaging the first and second linkages for biasing the linkages in opposite directions, an electrically energizable locking mechanism mounted to the housing, the locking mechanism including a reciprocating plunger for movement transverse to the longitudinal axis of the housing between a projected locking position and a retracted non-locking position, the second linkage having an opening for receiving the plunger when the plunger is in the projected locking position, the locking mechanism operative to move the bolt to the projected locking position when energized, a time delay circuit connected to the locking mechanism for controlling electrical power supplied to the locking mechanism, and a switch actuated in response to movement of the actuator member toward the second position, the switch connected to the time delay circuit for starting a time interval upon actuation of the switch for temporarily delaying deenergization of the locking mechanism for a predetermined time interval after the actuator member is moved toward the second position, wherein, when the locking mechanism is energized, movement of the actuator member toward the second position of the actuator member moves the first linkage to the second position of the first linkage for loading the spring and starting the time interval, the time delay circuit interrupting electrical power to the locking mechanism upon expiration of the time interval allowing the plunger to move to the non-locking retracted position and the second linkage to move to the second position of the second linkage under force of the spring for moving the latch bolt to the retracted position.

10. The combination of claim 9, the exit device further comprising:

a sensed element mounted to the door frame; and a sensor disposed in the housing adjacent to the latch bolt for sensing the sensed element when the door is in the closed position.

11. The combination as recited in claim 10, wherein the sensor is selected from a photoelectric switch, a magnetic reed switch, or a Hall effect sensor.

12. The combination of claim 9, the exit device further comprising a sensing device for sensing when a door is in a closed position, the door position sensing apparatus comprising:

a sensed element mounted to the door frame; and a sensor disposed in the housing adjacent to the latch bolt for sensing the sensed element when the door is latched in the closed position.

13. A door position sensing apparatus as recited in claim 12, wherein the sensor is selected from a photoelectric switch, a magnetic reed switch, or a Hall effect sensor.

14. The combination of claim 9 wherein the actuator member is a manually operated touch bar supported on the housing for movement form the first position spaced from the surface of the door to the second position closer to the door surface.

15. The combination of claim 9 wherein the locking mechanism comprises a solenoid.

* * * * *